US007878256B2

(12) United States Patent
Slack

(10) Patent No.: US 7,878,256 B2
(45) Date of Patent: Feb. 1, 2011

(54) BURST PLUG FOR A DOWNHOLE FLUID PASSAGE

(75) Inventor: Maurice W. Slack, Edmonton (CA)

(73) Assignee: Tesco Corporation, Houston, TX (US)

( * ) Notice: Subject to any disclaimer, the term of this patent is extended or adjusted under 35 U.S.C. 154(b) by 251 days.

(21) Appl. No.: 11/992,859

(22) PCT Filed: Oct. 6, 2006

(86) PCT No.: PCT/CA2006/001652

§ 371 (c)(1),
(2), (4) Date: Jun. 4, 2008

(87) PCT Pub. No.: WO2007/038878

PCT Pub. Date: Apr. 12, 2007

(65) Prior Publication Data

US 2009/0056955 A1 Mar. 5, 2009

(30) Foreign Application Priority Data

Oct. 6, 2005 (CA) ..... 2522626

(51) Int. Cl.
*E21B 33/12* (2006.01)
*E21B 33/00* (2006.01)
*E21B 34/00* (2006.01)

(52) U.S. Cl. ..... 166/386; 166/317; 166/319

(58) Field of Classification Search ..... 166/317, 166/376, 386, 316, 319, 321
See application file for complete search history.

(56) References Cited

U.S. PATENT DOCUMENTS

2006/0102338 A1* 5/2006 Angman et al. ..... 166/177.4

* cited by examiner

*Primary Examiner*—David J Bagnell
*Assistant Examiner*—Michael Wills, III
(74) *Attorney, Agent, or Firm*—Bracewell & Giuliani LLP

(57) ABSTRACT

A burst plug for positioning in a downhole fluid passage has: a shear disc installable in a sealing position in the fluid passage. The shear disc is openable by applying fluid at a burst pressure against the shear disc. The burst plug has a retainer and sleeve formed to retain the shear disc in a fluid flow blocking position after the shear disc is removed from its sealing position. The sleeve has a shear disc retaining position in locking engagement with the retainer when fluid at burst pressure is in communication therewith. The sleeve thereafter assumes a shear disc removal position when fluid in communication therewith is reduced to a selected pressure lower than the burst pressure. In the shear disc removal position, the sleeve and retainer disengage from the blocking position, allowing the shear disc and retainer to be expelled from the fluid passage.

28 Claims, 2 Drawing Sheets

BURST PLUG FOR A DOWNHOLE FLUID PASSAGE

FIELD OF THE INVENTION

The present invention relates to a downhole tool mechanism and, in particular, a burst plug for a downhole tool.

BACKGROUND OF THE INVENTION

Burst plugs are used in some downhole tools to provide a removable plug in the tool. Some fluid conveyed down hole tools, for example, include fluid passage bores that must be plugged for fluid conveyance, but are intended to be opened after placement to permit fluid flow therethrough. For example, in a pump down cement float, such as for example one of those described in PCT/CA2003/001889, filed Dec. 8, 2003 or Canadian patent application 2,311,160, published Dec. 9, 2001 (both to the present assignee), the float includes a bore along its length for passage downwardly therethrough of cement fluids, a check valve in the bore and a pressure responsive plug such as an expellable plug, also called a burst plug or disc, for holding pressure during pump down but removable, as by expelling or bursting at pressures above pumping pressure, to allow fluid flow through the bore, as controlled by the valve.

In those kinds of pump down cement floats, the float is conveyed down hole with the burst plug plugging the bore, but when desired, the fluid pressure above the float is increased to remove the plug from its plugging position in the bore. When pressuring up to burst the plug and open the bore, the check valve and/or the formation can be damaged by the surge of liquid that passes the check valve when the plug is removed.

SUMMARY OF THE INVENTION

In accordance with a broad aspect of the invention, there is provided a burst plug for positioning in a downhole fluid passage, the burst plug comprising: a shear disc installable in a sealing position in the fluid passage and openable by applying fluid at a burst pressure against the shear disc, a first part formed to retain the shear disc in a fluid flow blocking position after the shear disc is removed from its sealing position and the first part being selected to assume a shear disc retaining position when fluid at burst pressure is in communication therewith and thereafter to assume a second shear disc removal position when fluid in communication therewith is reduced to a selected pressure lower than the burst pressure.

In accordance with another broad aspect of the invention, there is provided a downhole tool comprising: a body including an upper end and a lower end, a fluid passage bore extending through the body from the upper end to the lower end, an upper seal creating a seal about body and a burst plug positioned in the bore, the burst plug including a shear disc in a sealing position to substantially prevent flow through the fluid passage bore and being responsive to a burst pressure to remove the shear disc from its sealing position and configure the shear disc in a flow-blocking position in the bore and being responsive to a second pressure lower than the burst pressure to move the shear disc from its flow-blocking position to increase fluid flow through the bore.

In accordance with another broad aspect of the invention, there is provided a method for opening a fluid passage bore through a downhole tool, the method comprising: providing a downhole tool including a body having an upper end and a lower end, a fluid passage bore extending through the body from the upper end to the lower end, an upper seal creating a seal about the body and a burst plug positioned to control fluid flow through the fluid passage bore, the burst plug including a shear disc in a sealing position to substantially prevent flow through the fluid passage bore and permitting staged removal; applying fluid at a burst pressure to remove the shear disc from its sealing position and move the shear disc to a flow-blocking position; reducing the fluid pressure to a second pressure lower than burst pressure; and using the second lower pressure to move the shear disc from its flow-blocking position to allow increased fluid flow through the bore.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
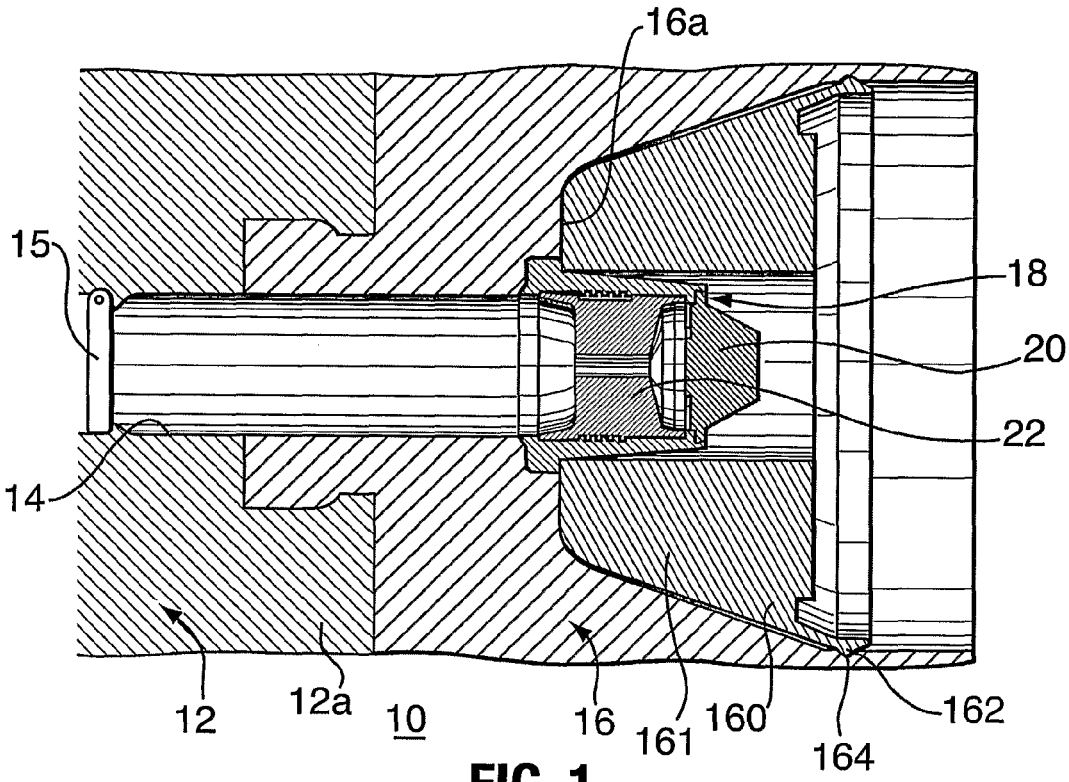
FIG. 1 is an axial section through a portion of a downhole tool including a burst plug according to one aspect of the present invention. A wiper plug land according to another aspect of the present invention is also shown.

FIG. 1 shows a portion of a fluid pressure-conveyed downhole tool in the form of a cement float 10 including the cement float body 12 with a fluid passage bore 14 extending from its lower end 12*a* to its upper end (not shown), a check valve 15 in the bore to seal against fluid flow through the bore from lower end to upper end, an upper seal 16, in this embodiment formed as a cup, capable of creating a seal about body 12 to prevent fluid flowing down past the tool when it is positioned in a wellbore and a controlled release burst plug 18 positioned in bore 14 to provide a removable plug therein.

Burst plug 18 may be positioned in a downhole fluid passage such as bore 14 of a pump down cement float, or other down hole tool, to provide a plug therein to permit the tool to be pumped down by a pump-down fluid pressure acting against the plug and upper seal cup 16. However, burst plug 18 may be opened by removal of all or a portion thereof from bore 14 when desired to permit flow through the bore. Burst plug 18 includes a shear disc 20 installed in a sealing position in bore 14. Shear disc 20 is configured to be create a substantial seal against fluid passing through bore such that, for example, it may be acted upon by pump-down fluid pressure and can permit pump-down conveyance of a tool in which it is positioned. Shear disc 20 is further configured to permit staged removal thereof by application of fluid pressure thereto. In staged removal, a first pressure is used to burst disc 20 and position it in a flow blocking position and a second pressure, which is lower than the first pressure, is used to further open the bore by expelling disc 20 from the flow-blocking position in the bore. The flow-blocking position is selected to protect against fluid at the first pressure freely passing through the burst plug. The shear disc may take various forms and may for example include various pressure breakable mounting configurations, including any of a mounting flange, a shear pin connection, a membrane, snap rings, sleeves, etc., various sealing mechanisms including o-rings, seals incorporated into the mounting configuration (i.e. a sealing portion on the mounting flange), bodies of various thicknesses including membranes, solid plugs, etc.

In one embodiment, the shear disc can be formed to be capable of mounting in a downhole fluid passage bore in a sealing position, to block flow through the bore, and in a first stage of removal is formed to open, as by bursting or breaking away from the sealing position, when fluid pressure thereabove is raised to a burst pressure, the burst pressure being selected to be at or above the pressure rating of the shear disc. Shear disc 20, in one embodiment, however, may be configured after opening to remain in a blocking position in the bore, for example, caught against a retainer 22 mounted in the bore. In the blocking position, the shear disc may totally prevent flow through the bore or may allow some fluid flow therepast. In one embodiment, for example, the burst plug is configured such that when the shear disc is in the blocking position, a low volume of fluid may flow past the shear disc.

In a second stage, the shear disc and/or the retainer can be expelled from bore 12 once the pressure above the assembly is reduced to a second pressure lower than the burst pressure. To achieve the second lower pressure, the fluid pressure that caused the shear disc to break away from its sealing position can be reduced gradually as by leaking past the shear disc in its flow-blocking position and/or by reduction at surface, as by opening a valve.

To provide a two-stage removal, a portion of the burst plug may be configured to remain in position in the tool when under burst pressure conditions, but to disengage from the tool when the pressure is reduced. Such an effect may be provided, for example, by forming a portion of the burst plug, such as retainer 22, to remain mounted in the tool when under a high pressure load and to assume a second removable position when a fluid pressure load lower than the higher pressure is applied thereto. Such a pressure response may be provided, for example, by use of materials with conditions that vary under different pressure loads, such as elastically or plastically deformable materials. For example, in one embodiment, the burst plug may include an elastically deformable portion that deforms to maintain the shear disc in a flow-blocking position relative to the tool when under burst pressure loads, but assumes another position when fluid pressure less than burst pressure is applied thereto that permits removal of shear disc 20 from its flow-blocking position.

Figure 2A:
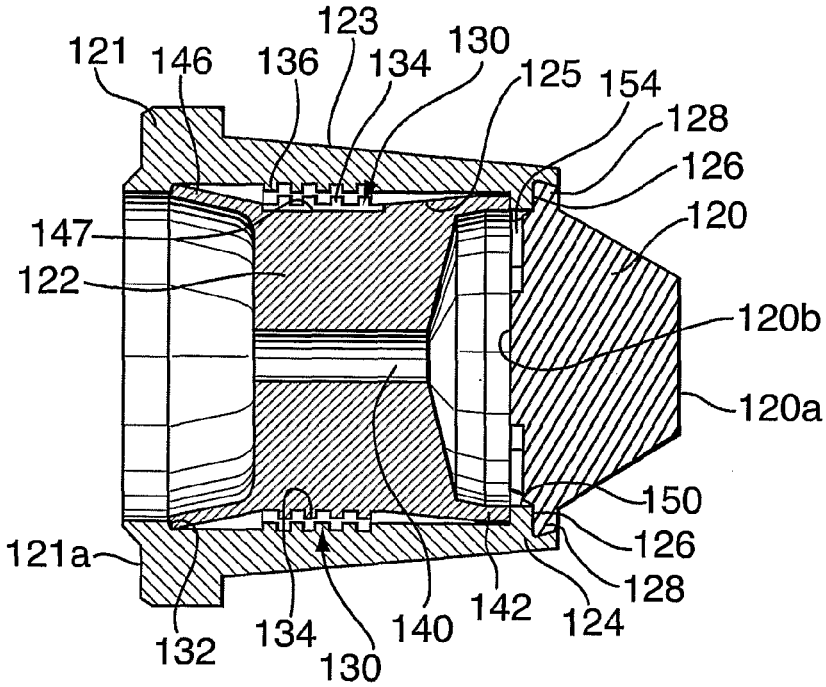
FIG. 2A is an enlarged axial section through a burst plug in a sealing position.

One embodiment of a burst plug assembly 118 according to the present invention is shown in FIG. 2. Burst plug assembly 118 includes three main parts including a shear disc 120, a retainer 122 and an installation sleeve 124.

Installation sleeve 124 is mountable in or at an open end of downhole fluid passage. Mounting may be by connection to or biasing against the material forming the downhole passage, but in any event creates a seal between the sleeve and the material forming the downhole passage to substantially prevent fluid leakage therebetween. With reference to FIG. 1, for example, installation sleeve 124 is shown mounted at the upper end of bore 14. Installation sleeve 124 has a side wall forming an axial bore 125 therethrough. In operation, axial bore 125 is placed in communication with the downhole fluid passage. As such, in the illustrated embodiment of FIG. 1, axial bore 125 of the sleeve acts as an extension of the tool's bore. In the illustrated embodiment, sleeve 124 is intended to be held in position relative to the bore, but is not intended to pass through the bore. In the illustrated embodiment, for example, sleeve 124 includes an enlarged portion 121 with an outer diameter greater than the inner diameter of the tool's bore. Enlarged portion 121 of the illustrated embodiment forms a seal 121*a* that acts against the tool to create a seal therebetween.

Sleeve 124 further includes an exposed outer surface 123. For operation, sleeve 124 is mounted relative to the downhole fluid passage such that outer surface is open to fluid pressures uphole of the tool on which the sleeve is to be mounted.

Sleeve 124 includes structures for engaging shear disc 120 in its sealing position and for releasably locking retainer 122.

In the illustrated embodiment, for example, sleeve 124 defines a land and lock shoulder 126 for sealingly engaging a flange 128 on the shear disc. It will be appreciated that the flange 128 and shoulder 126 may be configured to operate as in other pressure-actuated shear plug systems such that the flange fails or pulls away from the shoulder when a pressure above the flange/shoulder connection's fail pressure rating is applied against disc 120. As such, it will be appreciated that shoulder 126 is positioned on the sleeve such that disc is in communication with fluid pressures uphole of the tool on which the sleeve is mounted.

Sleeve 124 further includes a locking profile 130 for releasably engaging retainer 122 against axial movement through the sleeve at high uphole fluid pressures and a shoulder 132 for releasably engaging retainer 122 when it is under substantially no pressure load. It is noted that in the illustrated embodiment, locking profile 130 includes a plurality of grooves 134 formed to be capable of interengagement with corresponding grooves 136 located on the outer surface of retainer 122. Grooves 134, 136, may be for example, a series of non-helical, 8 Stub Acme-type grooves. Grooves 134 are formed radially inwardly of exposed outer surface 123. Sleeve 124 is at least in part formed of a resilient material that is selected to change shape in response to a high pressure load but to return to an original shape when such pressure load is removed. In particular, at least a portion of the annular wall between exposed outer surface 123 and grooves 136 is formed resiliently to deform from a normal position to a compressed position in response to a selected pressure load above a selected limit but to return to the normal position when the pressure load is reduced below the selected limit. The selected pressure may be less than the burst pressure rating of the shear disc. In the illustrated embodiment, the selected pressure may be between the pump-down pressure intended for operation of the tool in which the burst plug assembly is to be used and the burst pressure of the shear disc.

Retainer 122 includes an outer surface and a fluid passage bore 140 extending from its upper end 122*a* to its lower end 122*b*. As noted above, the outer surface includes grooves 136, or other structures, formed to releasably interlock with locking profile 130 on sleeve 124. Upper end 122*a* is formed as a cup including an annular wall 142 defining therebetween an indentation 144. Bore 140 opens from indentation 144. Annular wall 142 may be formed of a resilient material and may be formed to operate as a cup seal to expand in response to a pressure differential between indentation 144 and the outer surface of the annular wall. In such an embodiment, annular wall 142 may be selected to expand in response at least to burst pressure conditions. Lower end 122*b* includes a releasable breakaway seal 146 formed and positioned to releasably engage shoulder 132 on sleeve 124. Although breakaway seal 146 may take other forms, such as a shear flange, in the illustrated embodiment, seal 146 may be formed of resilient materials and may be formed to move in response to fluid flow therepast out of engagement with shoulder 132. The resilient properties of seal 146 may be selected to respond to pressures lower than burst pressure.

Shear disc 120 includes flange 128, as noted above, which separates an uphole side 120*a* from a downhole side 120*b*. Downhole side 120*b* is formed to fit into indentation 144 of the retainer. In one embodiment, the downhole side is formed with side walls 150 that closely fit against annular wall 142 such that a sealing configuration may be formed between the parts. The downhole side of shear disc 120, as shown, or the bottom wall of indentation includes seal compromising grooves 154 to permit partial fluid flow between the parts to bore 140.

Burst plug assembly 118 may be positioned in a downhole tool to control fluid flow through its bore. For operation, the sleeve is positioned in communication with the bore of the tool with exposed outer surface 123 exposed to uphole pressures. The retainer and the shear disc are positioned in the sleeve. In preparation for use, shear disc 120 is installed with its flange 128 engaged and sealed against land and lock shoulder 126 and retainer 122 is installed with its break away seal 146 supported against shoulder 132. In this position, downhole side 120*b* is spaced from, which in use will be uphole of, retainer 122.

In operation, fluid pressure in communication with the tool from above (as may be adjusted from surface) acts against uphole side 120*a* of shear disc 120. When shear disc 120 is in its sealing position, shown in FIG. 2A, flange 128 seals against land 126 and prevents fluid from moving therepast. Shear disc 120 is selected to remain in this position during pump down pressures, for example, which in one embodiment may be less than 1,500 psi.

Depending on the selected pressure under which the resilient portion of the sleeve's annular wall is selected to deform, when pump-down pressures are applied, the resilient portion of the sleeve's annular wall may, as desired, either be (i) in its normal position such that grooves 134 and 136 are out of engagement with each other (as shown) or (ii) in its constricted position with grooves 136 driven into engagement with grooves 134. Fluid pressure from above is isolated from retainer 122 and breakaway seal 146 of the retainer is engaged on shoulder 122, to hold the retainer in place.

Figure 2B:
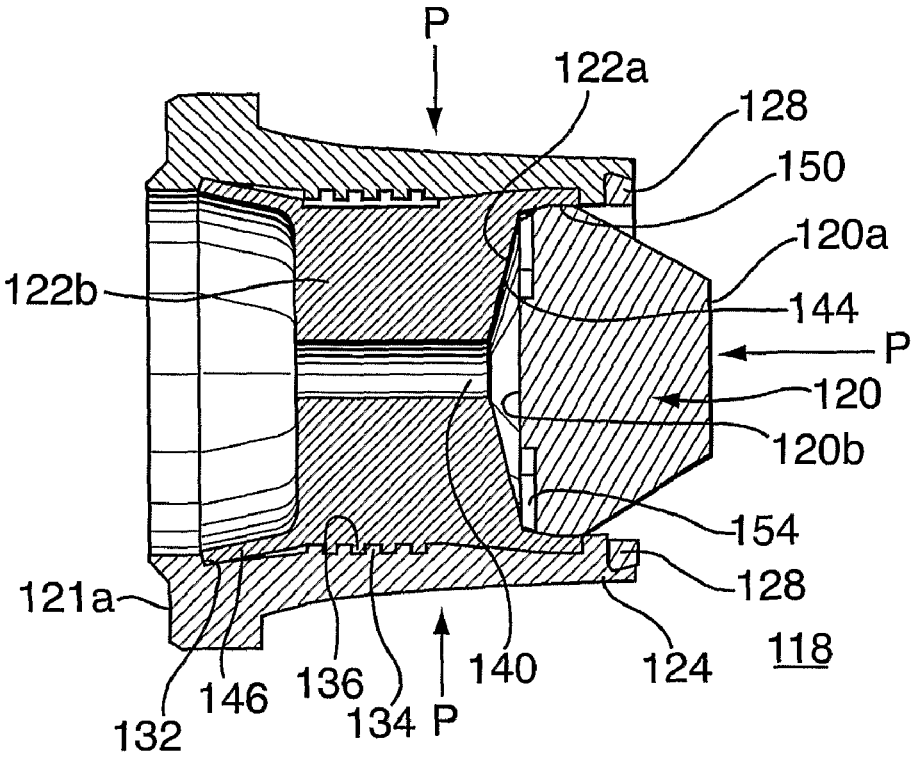
FIG. 2B is the burst plug of FIG. 2B with the shear disc in the blocking position just after shearing from the sealing position.
Figure 2C:
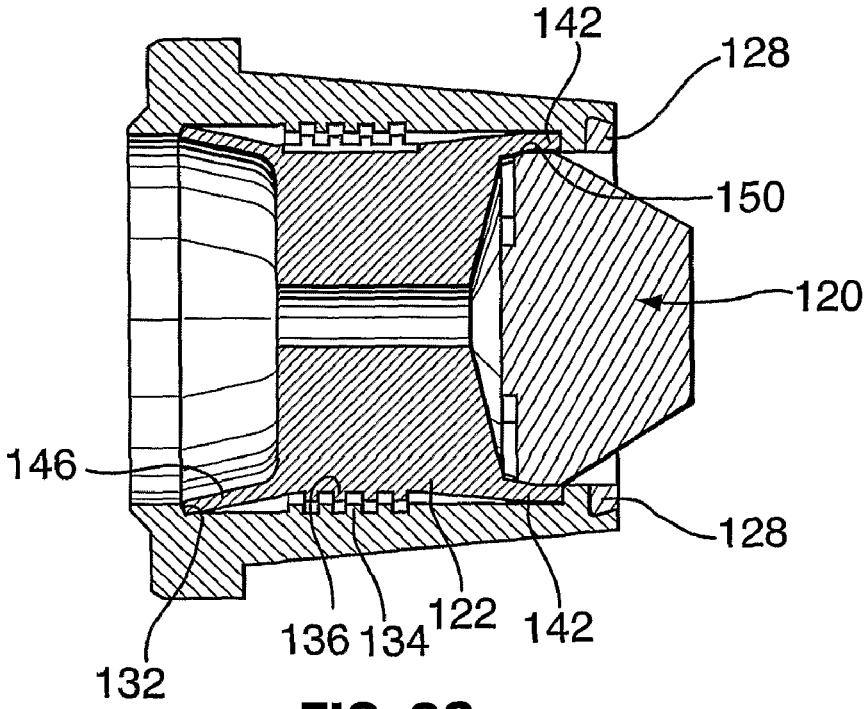
FIG. 2C is the burst plug of FIG. 2A with the shear disc and a retainer in a condition ready for removal.

When it is desired to open the bore of the tool by removal of the shear disc 120, fluid pressure above shear disc 120 may be increased to a pressure capable of shearing the disc. For example in one embodiment, a burst pressure equal to or greater than 1,500 psi may be useful. The burst pressure will also be in communication with and acting against outer exposed surface 123 of the sleeve. Burst pressure in FIG. 2B is illustrated by arrows P. The resilient portion of sleeve 124 may be selected to deform at a pressure below burst pressure such that by the time the fluid pressure is elevated to burst pressure, the annular wall has constricted radially inwardly to drive grooves 136 of the sleeve into engagement with grooves 134 of the retainer.

When disc 120 shears, for example by failure at flange 128 caused by a stress concentration therealong, disc 120 lands against retainer 122, as shown in FIG. 2B. After disc 120 shears out of its sealing position, fluid at burst pressures will come into contact with the retainer. By this time, however, the retainer is firmly engaged by sleeve 124 so that retainer is held to provide resistance to axial displacement of the retainer from the sleeve against the fluid surge at burst pressure and the force of disc 120 landing against the retainer. The formation of the upper end of the retainer including resilient annular wall 142 about the indentation causes fluid pressures to drive wall 142 out against sleeve 124 to create a seal against fluid passing between the sleeve and the retainer. In addition in the illustrated embodiment, this reaction of wall 142 in response to fluid pressures at burst pressure, causes an opening to be formed between the retainer and shear disc 120 to permit fluid to pass therebetween to grooves 154 and thereafter to bore 140. The fluid flow path provided between the disc and the retainer and through bore 140 permit fluid flow past the burst plug assembly but in a controlled manner to avoid damaging a valve of the tool, for example valve 15 in FIG. 1, or other components of the tool or well therebelow.

The interlock between grooves 134 and 136 permits the fluid to pass through the retainer without the retainer being ejected from sleeve 124 and therefore from the bore. Annular wall 142 embodies the primary seal preventing burst pressure from invading between retainer 122 and the sleeve, which would drive the grooves apart. The resilient nature of sleeve 124 ensures that once the pressure above the burst plug is reduced to a pressure below the selected pressure for the resilient material, as by relieving the pressure at surface and, to a much lesser degree, leaking between walls 142 and 150 and through grooves 154 and bore 140, walls 142 and the resilient portion of sleeve 124 resumes its normal shape. In particular, with reference to FIG. 2C, after the fluid pressure is reduced below burst pressure and in particular below the selected pressure at which the resilient materials respond, walls 142 resume their normal condition, which is in close tolerance against walls 150 of shear disc 120 and the sleeve wall between outer surface 123 and grooves 136 relaxes such that grooves 136 pull out of engagement with grooves 134. In such a condition, the retainer may be expelled from sleeve 124, and from the bore of the tool, by overcoming the engagement of breakaway seal 146 to shoulder 132. This may occur simply by the residual weight of fluid column above the retainer, but may be selected to occur by again raising the fluid pressure to an elevated pressure but which is less than the burst pressure. The elevated pressure may be selected not to damage any components of interest below the burst plug.

To facilitate removal of the retainer from the bore of the tool, it may be desirable to form retainer such that a fluid path is set up along the outer surface, between retainer 122 and sleeve 124, to drive grooves 134, 136 apart and to drive breakaway seal 146 out of engagement with shoulder 132. For example, a fluid bypass 147 may be formed between the retainer and the sleeve, for example on the outer surface of the retainer where a portion of grooves 136 have been removed. As another example, uphole side 120*a* of the disc may be formed with downwardly ramped surfaces leading to its edges to direct fluid towards annular wall 142. Since wall 142, after burst pressure is dissipated, will be in close tolerance against disc 120, fluid passing down over the uphole side of disc 120 will tend to flow between retainer 122 and sleeve 124. Disc 120 and wall 142 may be correspondingly sized and shaped to facilitate movement of fluid over the surface of the shear disc and over the wall toward the outer surface of the retainer. For example, the height of wall 142 may follow or be slightly stepped back from the curvature of the shear disc at its edges.

In previous cement floats, energy stored primarily in the pressured liquid column is released suddenly when the disk bursts resulting in both a 'rebound' of the casing at surface and a down hole pressure surge felt by the formation directly below the casing. Using a burst plug assembly according to the present invention, pump down tool disc burst capacity can still be achieved in the existing pressure of, for example, equal to or greater than about 1500 psi, but the bore may not fully open until after the pressure has been reduced slowly. This, thereby, protects the formation and the tool below the shear disc from burst pressures.

It will be appreciated that the entire sleeve may be formed of resilient materials, if desired. It will also be appreciated that the two-stage burst plug may be provided by forming a part other than the sleeve, such as the retainer, to react to pressure changes to be engaged in the tool at burst pressures but removable at lower pressures.

FIG. 1 also shows a wiper plug stand 160 according to another aspect of the present invention. The wiper plug stand is an insert for the uppermost cup seal 16 of a cement float, and includes a body 161 that rests against base 16*a* of the cup seal to raise the effective height of the base of the cup seal. Body 161 is formed of durable materials capable of acting as a stop against which items intended to land on seal cup 16 may be prevented from damaging contact with the seal cup walls 16*b*.

A packer cup in which the wiper stand might be useful is described in detail in PCT/CA2003/001890, but of course a wiper stand according to the present invention may be useful in other forms of packer cups where it is intended that items are to be landed on top of the packer cup.

Wiper stand includes a mounting arrangement to secure the stand in the packer cup. In the illustrated embodiment, the mounting arrangement includes a protrusion 162 that engages in a groove 164 in the inner wall of the packer cup. The mounting arrangement must secure the stand without compromising the sealing operation of the seal. Thus, protrusion 162 permits the passage therepast of fluid to act against the packer cup walls and permits sealing flex of the packer cup walls.

The wiper stand is selected to prevent a bottom plug wiper or other device landing thereon from invading into the packer cup so far as to collapse it and compromise its function as a seal and or introduce debris that may clog cement flow paths. In the illustrated embodiment, the wiper stand height was selected to land the bottom of a wiper plug with just the first 'fin' into the top of the cup.

In the illustrated embodiment, the wiper stand also holds burst plug 18 in place, but of course the disc may be held by other means if desired, even if the wiper stand is not used with it. On the other hand, the wiper stand need not be used with the controlled burst plug, if so desired. In particular, it is to be understood that the controlled release burst plug and the wiper stand can be used independently of each other if desired. Also, the burst plug and the wiper stand can be used on other downhole applications and tools, apart from a cement float, if desired.

In the illustrated embodiment, the controlled release burst plug and a wiper stand functions may, if desired, be installed in cement floats of existing designs with only a minor modifications thereto to accept installation of the wiper stand and the burst plug. For example, if it was desired to install the burst plug in an existing design of a cement float, the bore of the an existing cement float may have to be adapted to accept the retainer. If it was desired to install a wiper stand in a packer cup of an existing design downhole tool, it may be necessary to form the packer cup or the tool body to retain the stand.

All parts relevant to the assembly may be variously constructed and of various materials. In one embodiment, for example, the burst plug and the wiper plug stand may be manufactured of drillable materials, for example using polymerics such as 70 Duro hi-temp polyurethane.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the invention. Moreover, nothing disclosed herein is intended to be dedicated to the public. No element is to be construed under the provisions of 35 USC 112, sixth paragraph, unless the element is expressly recited using the phrase "means for" or "step for".

I claim:

1. A burst plug for positioning in a downhole fluid passage, the burst plug comprising:

a shear disc installable in a sealing position in the fluid passage, blocking fluid flow through the passage and being releasable from the sealing position to a fluid flow-restricting position by applying fluid at a burst pressure against the shear disc, the flow-restricting position restricting fluid flow through the passage;

a first part having a shear disc retaining position to retain the shear disc in the fluid flow restricting position after the shear disc is removed from the sealing position and the first part is in communication with the burst pressure; and the first part thereafter assuming a shear disc removal position when fluid in communication with the first part is reduced to a selected pressure lower than the burst pressure, the shear disc being expellable from the passage while the first part is in the shear disc removal position and the fluid in communication with the first part is at the selected pressure.

2. The burst plug of claim 1 wherein:

the first part comprises a portion formed of resilient material that has an initial position while not being exposed to fluid pressure and is deformed into the shear disc retaining position while exposed to sufficient pressure and relaxes back to the initial position when the selected pressure is applied.

3. The burst plug of claim 1 wherein the first part comprises:

a sleeve having an initial configuration; and the portion of the resilient material comprises a sidewall of the sleeve that is formed to be in a deformed configuration when exposed to the burst pressure.

4. The burst plug of claim 1 wherein the first part comprises a retainer positioned downhole of the shear disc, the shear disc moving downhole into contact with the retainer while moving from the sealing position to the fluid flow-restricting position.

5. The burst plug of claim 1 wherein the first part comprises:

a sleeve, and the portion of the resilient material comprises a sidewall of the sleeve having an initial position when not exposed to fluid pressure and being deformable into the shear disc retaining position when exposed to sufficient fluid pressure, the sidewall of the sleeve being in the shear disc retaining position when exposed to the burst pressure; and a retainer positioned downhole of the shear disc to retain the shear disc in the fluid flow restricting position, the retainer formed to interengage with the sleeve sidewall when the sidewall is deformed.

6. The burst plug of claim 5 further comprising a fluid bypass passage within an annulus between the retainer and the sleeve, the fluid bypass passage allowing fluid to flow past the burst plug while the shear disc is in the fluid flow-restricting position.

7. The burst plug of claim 1 further comprising a retainer to retain the shear disc in the fluid flow restricting position and while the shear disc is exposed to the burst pressure.

8. The burst plug of claim 7 wherein the retainer includes an outer surface and a fluid passage bore extending from an upper end to a lower end of the retainer.

9. The burst plug of claim 7 wherein the retainer includes an outer surface including grooves formed to releasably interlock with a locking profile on a mounting structure formed to secure the retainer.

10. The burst plug of claim 7 wherein the retainer includes an outer surface, an upper end and a lower end, the upper end formed as a cup including an annular wall defining therebetween an indentation sized to accept the shear disc therein.

11. The burst plug of claim 10, wherein the retainer further includes a bore extending from the upper end to the lower end and the bore opens from the indentation.

12. A downhole tool comprising:

a body including an upper end and a lower end;

a fluid passage bore extending through the body from the upper end to the lower end of the body;

a burst plug positioned in the bore, the burst plug including a shear disc in a sealing position to substantially prevent flow through the fluid passage bore and being responsive to a burst pressure to remove the shear disc from the sealing position and configure the shear disc in a flow restricting position in the bore; and the burst plug being responsive to a second pressure that follows the burst pressure and is lower than the burst pressure to move the shear disc from its flow restricting position out of the bore to increase fluid flow through the bore.

13. The downhole tool of claim 12 wherein during movement of the shear disc from the sealing position to the flow-restricting position, the shear disc is sheared away from its sealing position and displaced along an axis of the bore to the flow-restricting position.

14. The downhole tool of claim 12 wherein the shear disc includes a mounting mechanism actuated to shear by application of the burst pressure.

15. The downhole tool of claim 12 further comprising:

a retainer positioned within the bore downward from the shear disc while the shear disc is in the sealing position; and wherein in the flow restricting position, the shear disc moves downward in the bore and becomes lodged against the retainer.

16. The downhole tool of claim 12 wherein in the flow restricting position, the shear disc seals against fluid flow through the bore.

17. The downhole tool of claim 12 wherein in the flow restricting position, the shear disc permits a limited flow of fluid through the bore of the tool, the limited flow of fluid being less than the flow of fluid that occurs when the shear disc is out of the bore.

18. The downhole tool of claim 12 wherein the burst plug comprises:

a first part formed to retain the shear disc in the flow restricting position after the shear disc is removed from the sealing position;

the first part being movable from an initial position to a shear disc retaining position in response to an increase in fluid pressure, the first part being in the shear disc retaining position when fluid at the burst pressure is in communication with the first part; and the first part being movable back to the initial position when fluid in communication with the first part is reduced from the burst pressure to the second pressure, which allows the shear disc to be expelled from the bore.

19. The downhole tool of claim 18 wherein the first part is elastically deformable from the initial position to the shear disc retaining position in response to an increase in fluid pressure.

20. The downhole tool of claim 12 wherein the shear disc while in the sealing position acts to permit the tool to be conveyed downhole by pump-down pressure.

21. The downhole tool of claim 18 wherein the first part is exposed to the same fluid pressure as the shear disc while the shear disc is in the sealing position.

22. A method for opening a fluid passage bore through a downhole tool, the method comprising:

providing a downhole tool including a body having an upper end and a lower end, a fluid passage bore extending through the body from the upper end to the lower end, a burst plug positioned to control fluid flow through the fluid passage bore, the burst plug including a shear disc in a sealing position to substantially prevent flow through the fluid passage bore;

applying fluid at a burst pressure to move the shear disc from the sealing position into a flow restricting position that restricts fluid flow through the bore; and reducing the fluid pressure from the burst pressure to a lower pressure lower than the burst pressure; and using the lower pressure to move the shear disc from its flow restricting position out of the bore to allow increased fluid flow through the bore.

23. The method of claim 22 wherein the lower pressure is achieved by relieving fluid pressure at surface.

24. The method of claim 22 wherein a portion of the burst plug is configured to retain the shear disc in the flow restricting position and to remain in the flow-restricting position in the tool when the burst pressure is applied to the portion, but to disengage the shear disc from the tool when the pressure applied to the portion is reduced to the lower pressure.

25. The method of claim 24 wherein the portion of the burst plug is selected to remain mounted in the tool when burst pressure is applied to the portion and to be expelled from the bore along with the shear disc when the lower pressure is applied to the portion following the burst pressure.

26. The method of claim 24 wherein the portion of the burst plug is formed of a material with properties that vary between the burst pressure and the lower pressure.

27. The method of claim 24 wherein the portion of the burst plug is formed of an elastically deformable material.

28. The method of claim 22 wherein the burst plug includes an elastically deformable portion that deforms to maintain the shear disc in the flow restricting position relative to the tool when the burst pressure is applied to the deformable portion, but assumes another position when the lower pressure is applied to the deformable portion to permit removal of shear disc from its flow restricting position.

* * * * *